United States Patent [19]

Grötsch

[11] Patent Number: 4,892,428

[45] Date of Patent: Jan. 9, 1990

[54] TIP REMOVAL DEVICE

[75] Inventor: Gerald Grötsch, Fürth, Fed. Rep. of Germany

[73] Assignee: J. S. Staedtler GmbH & Co., Fed. Rep. of Germany

[21] Appl. No.: 112,997

[22] Filed: Oct. 27, 1987

[30] Foreign Application Priority Data

Nov. 27, 1986 [DE] Fed. Rep. of Germany ..... 3640517

[51] Int. Cl.[4] ..... B43K 13/00; B43K 9/00

[52] U.S. Cl. ..... 401/258; 401/195; 401/243

[58] Field of Search ..... 401/195, 258, 209, 251, 401/243, 244, 290

[56] References Cited

U.S. PATENT DOCUMENTS

| | | | |
|---|---|---|---|
| 1,253,309 | 1/1918 | Ulleland | 401/290 X |
| 2,453,491 | 11/1948 | Cardin | 401/244 |
| 3,767,035 | 10/1973 | Koelichen | 401/258 X |
| 3,944,372 | 3/1976 | Verona | 401/244 |
| 4,493,575 | 1/1985 | Mutschler | 401/195 |
| 4,558,966 | 12/1985 | Mikuteit | 401/251 X |

FOREIGN PATENT DOCUMENTS

| | | | |
|---|---|---|---|
| 1810328 | 11/1968 | Fed. Rep. of Germany . | |
| 7140632 | 10/1972 | Fed. Rep. of Germany . | |
| 8104780 | 2/1981 | Fed. Rep. of Germany . | |
| 3434187 | 3/1986 | Fed. Rep. of Germany . | |
| 530283 | 7/1955 | Italy | 401/209 |
| 619349 | 3/1949 | United Kingdom | 401/244 |

*Primary Examiner*—Steven A. Bratlie

*Attorney, Agent, or Firm*—Pascal & Associates

[57] ABSTRACT

An axially removable cylindrical holding shaft or cap for placement over and for unscrewing or removing the tip of a writing or drawing instrument, the holding shaft or a cap having a receiving bore for the instrument tip, and being comprised of at least one approximately axially extending lever which can be tilted about an axis extending approximately tangentially to the cylinder wall. The lever has an arm on each side of the axis. One of the arms forms part off the wall and has a detent at its end, the detent projecting into the receiving bore for engaging a groove or an undercut of the tip when the tip is inserted into the receiving bore, fixing the tip in the axial direction. The structure makes it possible to clean the adjustment system of the tip, avoiding the danger of getting it dirty, and without touching the tip while reinserting it into the housing.

12 Claims, 4 Drawing Sheets

A
B

IV
IV

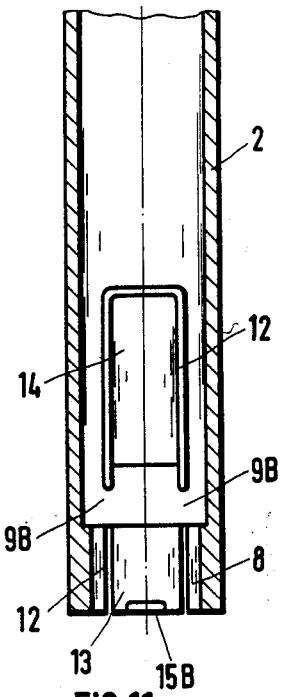
FIG. 11
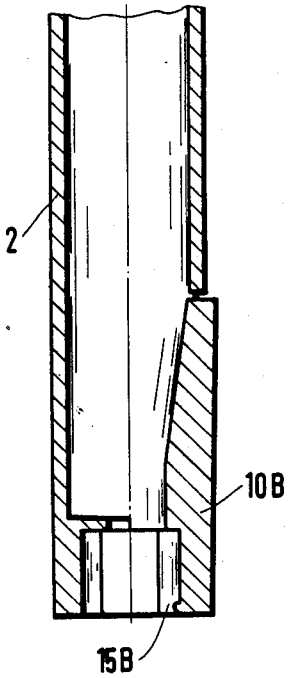
FIG. 10
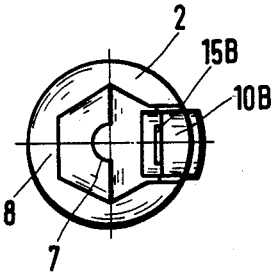
FIG. 12
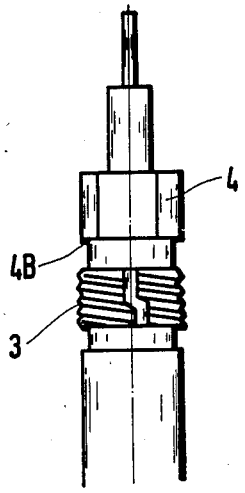

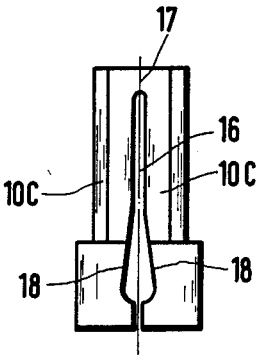
FIG. 14
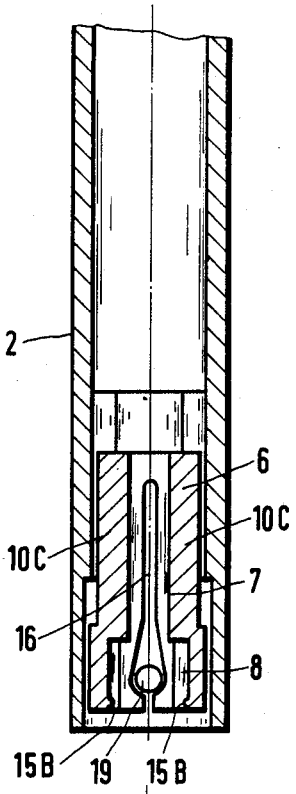
FIG. 13
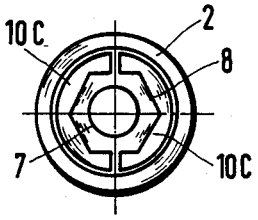
FIG. 15
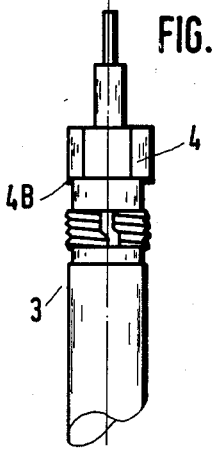

TIP REMOVAL DEVICE

The invention relates to writing or drawing instruments, and in particular to a cylindrical holding shaft which can be removed from the writing or drawing instrument.

A holding shaft or cap for a writing or drawing instrument is described in German Design Patent 71 40 632. The back end of the removable shaft has an internal thread which can be screwed onto an external thread at the writing tip of the instrument, as a result of which the tip can be removed from the instrument housing. This makes it possible to clean the adjustment system of the tip, avoiding the danger of it getting dirty. In this way, it is also possible to reinsert the tip into the housing without touching it. A disadvantage of the structure is that the holding shaft must always be screwed onto the tip in an awkward manner and then be unscrewed from it again. Moreover, there is the danger that both the above-noted threads will get dirty or become ink or dirt encrusted, so that it is necessary to clean them prior to the screwing procedure.

In a device described in German Patent 18 10 328, the receptacle for the tip has two key faces at the back end of the holding shaft, the key faces being congruent to two key faces which are formed at the tip. Moreover, the receiving bore is provided with two wart-like protrusions which come to rest against an outer surface of the tip. With this type of a receptacle, it is possible to unscrew the writing tip from the instrument, whereby the wart-like protrusions are supposed to guarantee that the tip is secured in the receptacle of the holding shaft. However, in this structure it is necessary to provide closely-spaced tolerances at the wart-like protrusions and at those surfaces of the tip against which these protrusions come to rest. There is, therefore, the danger that the tip will unintentionally fall out of the receptacle.

In a device described in German Design Patent 81 04 780, the receptacle of a key insert has a hexagonal bore which can be turned via a hexagon formed on the tip. In a continuation of this hexagonal bore, a cylindrical elongation having plier-like tongues is provided which comes to rest against the front part of the tip. Closely-spaced tolerances are also required at this location in the receptacle, since otherwise the tip is held either too tightly or falls out of the receptacle. The device described in German Design Patent 81 36 741 also has these disadvantages.

In a device described in German Patent 34 34 187, an inner thread, which can be screwed onto an outer thread at the tip, is formed at the back end of the holding shaft. The inner thread extends only over a peripheral area of 240°, whereas the remaining peripheral area consists of a sector-shaped cutout which has a larger diameter in comparison to it. In order to loosen the two threads, the axis of the holding shaft is turned opposite the axis of the tip, by means of which the holding shaft expands in the area of the inner thread and the outer thread reaches the tip in the sector-shaped cutout. In this device, a disadvantage is that the receptacle on the holding shaft is formed in a complicated manner and further that an unusual operation is required to loosen the screw coupling.

It is the object of the invention to construct the cylindrical part in the form of a holding shaft or a cap in such a way that, with simple manipulation and relatively large tolerances, a secure hold of the tip is guaranteed in the receptacle of the part.

A preferred embodiment of the invention is an axially removable cylindrical holding shaft or cup for placement over and for unscrewing or removing the tip of a writing or drawing instrument, the holding shaft or a cap having a receiving bore for the instrument tip, and being comprised of at least one approximately axially extending lever which can be tilted about an axis extending approximately tangentially to the cylinder wall, the lever being comprised of a gearing means for detachably engaging the tip when the tip is inserted in the receiving bore, fixing the tip in axial direction.

A preferred and other embodiments of the invention is described in greater detail in the following description with reference to the drawings, in which:

FIG. 10 is an illustration corresponding to FIG. 6 according to a third embodiment;

FIG. 11 is a further longitudinal section in this third embodiment;

FIG. 12 is a front view corresponding to FIG. 3 in this third embodiment;

FIG. 13 is an illustration corresponding to FIG. 6 according to a fourth embodiment;

FIG. 14 is a side view of the receptacle according to FIG. 13, and

FIG. 15 is a view corresponding to FIG. 3 of this fourth embodiment.

Figures 1, 2, 3, 4, 5, 6:
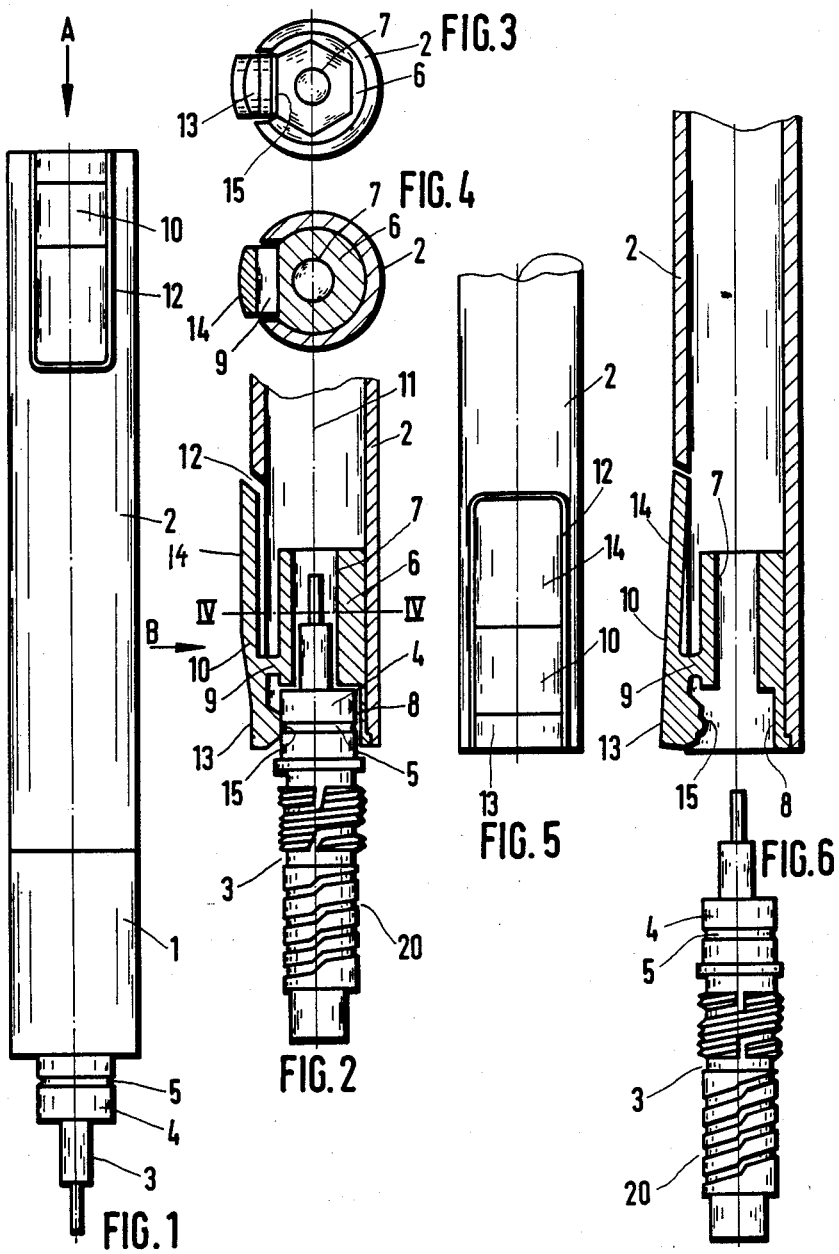
FIG. 1 is a side view of a first embodiment of the writing or drawing instrument.
FIG. 2 is a section through the back end of the holding shaft showing a tip held by the receptacle.
FIG. 3 is a front view onto the back end of the holding shaft in direction of arrow A according to FIG. 1.
FIG. 4 is a section along the line IV—IV in FIG. 2.
FIG. 5 is a view in direction of arrow B in FIG. 2.
FIG. 6 is a section through the back end of the holding shaft in a position for receiving the instrument tip which is also illustrated.

Turning to FIGS. 1–6, illustrated drawing instrument has a housing 1 with an ink reservoir which is not shown. A holding shaft 2 in form of a cylinder, which has a receptacle at its back end, is mounted onto this housing 1. The instrument tip 3 is screwed into housing 1. If the holding shaft 2 is removed and placed with its receptacle onto tip 3, then tip 3 can be unscrewed from housing 1.

A hexagon 4 is formed at tip 3. The surfaces of the hexagon 4 are interrupted by a groove 5, which also has a hexagonal form in sectional view.

The receptacle 6 has a cylindrical bore 7, which serves to receive the front end of the writing tip 3. A bore 8, hexagonal in cross-section, which is formed congruent to hexagon 4, connects externally to this bore 7.

An elastic flange 9, at which in turn a lever 10 is placed, is attached to the wall forming bore 7. This lever 10 extends approximately parallel to the axis 11 of cylinder 2. In the area of lever 10, the wall of cylinder 2 has a recess 12.

Lever 10 has a first arm 13 and another arm 14. Arm 14 can, in this case, be constructed as a clip for cylinder 2.

Arm 13 forms part of a wall of the hexagonal bore 8 and is provided with a detent 15. If no pressure is applied to lever arm 14, then detent 15 is closer to axis 11 than to the other surfaces of the hexagonal bore 8.

If radial pressure is applied to lever arm 14, then lever 10 assumes a position according to FIG. 6, in which lever arm 13 and, thus, detent 15 are tilted outward. In this way, receptacle 6 can be mounted onto tip 3, whereby hexagon 4 of tip 3 is covered over by the hexagonal bore 8 at the back end of cylinder 2. If lever arm 14 is now released, then detent 15 catches in groove 5 of tip 3, as a result of which this tip is axially secured in receptacle 6 and thus to cylinder 2. Due to the hexagonal engagement between hexagon 4 and bore 8, tip 3 can now be unscrewed out of housing 1 or screwed into it.

In the embodiment shown, receptacle 6 is inserted into the back end of cylinder 2. These two parts can alternatively be made as one piece.

If we are dealing with a writing or drawing instrument in which tip 3 can be pulled out from housing 1 or slipped into it, then groove 5 can be shaped round and detent 15 circular.

As shown in FIG. 2, the tip can be securely and undetachably held with its adjustment system 20, so that tip 3 can be cleaned without the danger of getting it dirty.

Figure 8:
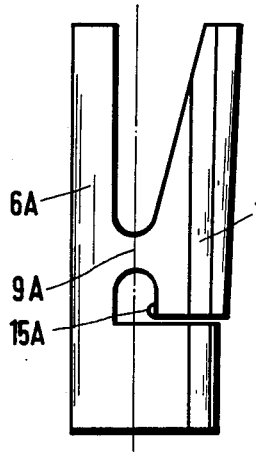
FIG. 8 is a side view of the receptacle of FIG. 7.
Figure 7:
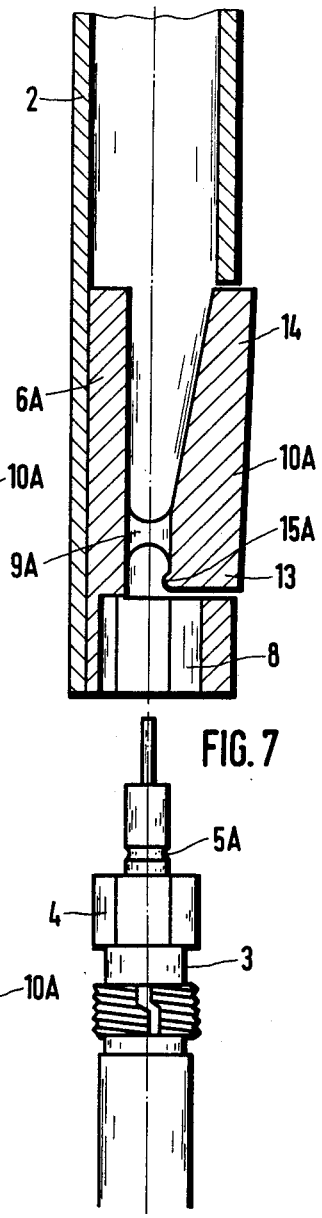
FIG. 7 is an illustration corresponding to FIG. 6 in a second embodiment.
Figure 9:
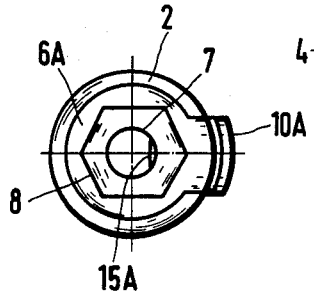
FIG. 9 is a front view corresponding to FIG. 3 according to a second embodiment.

In the embodiment shown in FIGS. 7 to 9, receptacle 6A also has a two-armed lever 10A which is connected via two elastic flanges 9A with the rest of receptacle 6A. Lever arm 13 is made relatively short and has a detent 15A which engages in a groove 5A of tip 3. In this embodiment, the hexagonal bore 8 is completely formed.

In the embodiment shown in FIGS. 10 to 12, the receptacle is made as one piece with cylinder 2 and has a solidly formed lever 10B which is connected via two elastic flanges 9B, which are formed by the cylinder wall, with the cylinder. Arm 13 of lever 10B has, at its front end, detent 15B which catches behind shoulder 4B of hexagon 4 of tip 3 when tip 3 is inserted into the receiving bore 7, 8.

The manner of operation of the above-described embodiments is basically the same in each case.

In the embodiment shown in FIGS. 13 to 15, receptacle 6 is inserted axially adjustable into cylinder 2. This receptacle 6 has two levers 10C extending in a fork-like manner, at the ends of which detents 15B are formed. The two levers 10C are separated from one another by two slots 16 and connected to one another by two elastic flanges 17. The two slots 16 each have inclined planes 18 at their front end. In the area of the inclined planes 18, a peg 19 of cylinder 2 engages in each case.

If tip 3 is inserted into bores 7, 8 of receptacle 6, then the levers 10C are forced apart until detents 15B catch behind shoulder 4B. If tip 3 is removed, then inclined planes 18, tapering toward the back, abut against pegs 19, whereby pegs 19 force the two levers 10C apart, so that the detents 15B disengage from shoulder 4B and, therefore, tip 3 can be removed from receptacle 6.

In a variation of this embodiment, one only has to provide a lever 10C which supports the detent and which can be flexibly turned with respect to the rest of receptacle 6.

I claim:

1. An axially removable cylindrical holding shaft or cap for placement over and for unscrewing and removing a tip of a writing or drawing instrument, said holding shaft having a receiving bore for that instrument tip and being comprised of at least one approximately axially extending lever in a wall of said receiving bore, said lever being tiltable about an axis extending approximately tangentially to said wall, wherein said lever has an arm on each side of said axis, one of said arms forming a part of said wall and having a detent at its end, said detent projecting into said receiving bore for engaging one of a groove and an undercut of said tip when said tip is inserted in said receiving bore, fixing said tip in said receiving bore in axial direction, said detent being disengaged from said tip by means of radial pressure exerted on the other of said arms.

2. A shaft or cap as defined in claim 1, having at least one recess for said one arm in the area of the receiving bore.

3. A shaft or cap as defined in claim 1 the lever being connected thereto via at least one elastic flange for keeping said detent engaged with said tip.

4. A shaft or cap as defined in claim 1 in which the other arm is constructed as a clip.

5. A shaft or cap as defined in claim 1, in which said detent and said one of the groove and the undercut extend along a tangential line.

6. A shaft or cap as defined in claim 5, said receiving bore being many sided, said tip being in the shape of a polygon to which said bore is congruent, the detent being parts of the many-sided bore.

7. A shaft or cap as defined in claim 1, constructed as one piece.

8. An axially removable cylindrical holding shaft or cap for placement over and for unscrewing or removing a tip of a writing or drawing instrument, said holding shaft having a receiving bore for that instrument tip and being comprised of at least one approximately axially extending lever in a wall of said receiving bore, said lever being tiltable about an axis extending approximately tangentially to said wall, said receiving bore being a part of a receptacle which is axially movable in said shaft or cap, said receptacle having two levers extending in a forked manner to one another, which are separated from one another by slots and connected to one another by at least one flange, at least one of said slots having an inclined plane edge, the shaft or cap having a peg disposed in the area of said inclined plane edge for forcing the levers apart, at least one of said levers having a detent at its end for engaging one of a groove and an undercut of said tip when said tip is inserted in said receiving bore, fixing said tip in said receiving bore in an axial direction, said detent being disengaged from said tip by abutting said inclined plane edge against said peg when said receptacle is moved axially outwardly of said shaft or cap.

9. A shaft or cap as defined in claim 8, said flange being an elastic flange for keeping said detent engaged with said tip.

10. A shaft or cap as defined in claim 9, in which the detent and the groove or the undercut extend along a tangential line.

11. A shaft or cap as defined in claim 9, said bore being many sided, the tip being in the shape of a polygon to which the bore is congruent, the detent being part of the many-sided bore.

12. A shaft or cap as defined in claim 9, said receptacle being constructed as one piece.

* * * * *